United States Patent [19]

Ullman et al.

[11] Patent Number: 4,788,926

[45] Date of Patent: Dec. 6, 1988

[54] COMBINED BOAT FENDER AND EMERGENCY LADDER

[75] Inventors: Johan M. Ullman, Barnhemsgatan 23, Linköping; Fredrik Aust, Västra Frölunda, both of Sweden

[73] Assignee: Johan Ullman, Linkoping, Sweden

[21] Appl. No.: 31,066

[22] PCT Filed: Jun. 13, 1986

[86] PCT No.: PCT/SE86/00286

§ 371 Date: Feb. 9, 1987

§ 102(e) Date: Feb. 9, 1987

[87] PCT Pub. No.: WO87/00139

PCT Pub. Date: Jan. 15, 1987

[30] Foreign Application Priority Data

Jun. 28, 1985 [SE] Sweden ..... 8503242-3

[51] Int. Cl.[4] ..... B63B 59/02

[52] U.S. Cl. ..... 114/219; 114/362; 182/196; 182/70

[58] Field of Search ..... 114/362, 219, 230; 405/212; 182/196, 70

[56] References Cited

U.S. PATENT DOCUMENTS

| | | | |
|---|---|---|---|
| 2,072,387 | 3/1937 | Sneed | 114/230 |
| 2,722,359 | 11/1955 | Craft | 114/362 |
| 3,026,548 | 3/1962 | Dollinger | 114/219 |
| 3,411,166 | 11/1968 | Kimmel | 182/196 |
| 4,376,419 | 3/1983 | Heilskov | 114/219 |
| 4,494,474 | 1/1985 | Saito | 114/362 |

*Primary Examiner*—Joseph F. Peters, Jr.
*Assistant Examiner*—Edwin L. Swinehart
*Attorney, Agent, or Firm*—Sughrue, Mion, Zinn, Macpeak and Seas

[57] ABSTRACT

A boat fender (1) is provided with footstep or handgrip openings (8, 9) at its top and bottom to serve as a ladder for assisting an overboard person. The fender may further be made of two easily separable body members (3, 4), with one of them being hollow and storing a folded rop ladder (6) coupled to the other one.

4 Claims, 2 Drawing Sheets

COMBINED BOAT FENDER AND EMERGENCY LADDER

Figure 1:
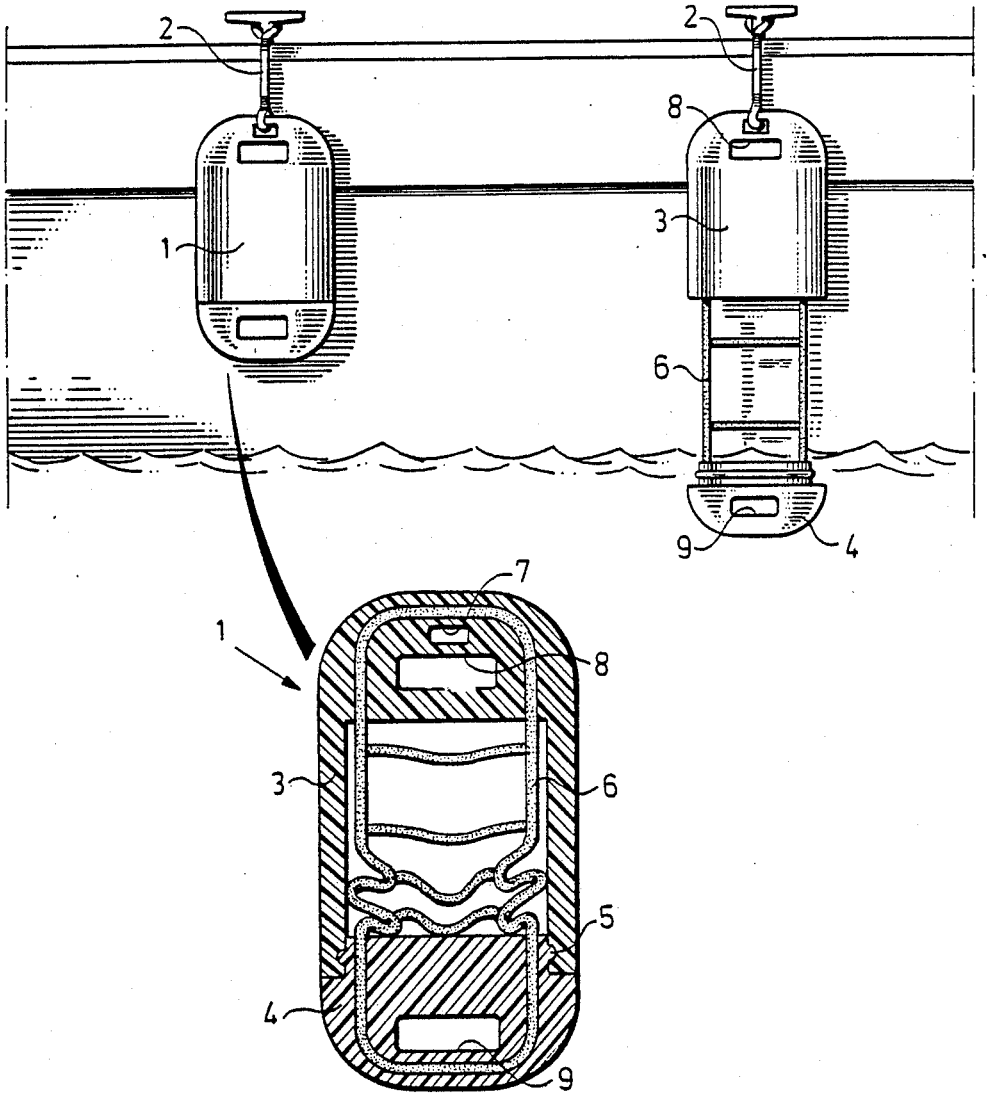

The present invention relates to fenders and has for its object to provide a fender which may be used also as a life-saving equipment. The inventive concept is based on the following factual circumstances and conclusions.

When a person falls overboard from a boat the usual method of assisting him is from the boat to through out a life-buoy or the one end of a rope. This obviously requires that aboard the boat there is some individual which both becomes aware of the situation and is capable of taking suitable measures. Consequently, these conditions are not satisfied when the person who has fallen into the water was either the only one aboard or accompanied by small children only. It may even occur that the accident is not observed if the other persons aboard are either asleep or the environmental conditions suppress cries for help, e.g. during extreme weather conditions or when there is a high background noise. Such a situation becomes especially critical when the water temperature is low because a person in the water may then become unconscious after 5–10 minutes. Consequently, there exists a need of making it possible for a person, who has fallen overboard from a boat, without any assistance from others to return aboard. The inventive concept is based on the realization that a fender, suspended at the side of a boat, can be given another function in addition to its primary one, namely be arranged so that it may also serve as a ladder. It should already here be underlined that the function of the device may be very different according to different embodiments of the invention and the local conditions, especially the distance of the fender from the water surface, the freeboard of the boat etcetera. However, a device according to the invention always provides a possibility quickly to grip an object which is located between the water surface and the boat deck and which, at least in the majority of cases, makes it possible for the person in the water himself to climb back aboard.

The invention will now be described in greater detail by reference to the drawing illustrating two embodiments thereof.

FIG. 1 shoes diagrammatically a section of the one side of a boat having two fenders according to the first embodiment of the invention. The one fender is shown in its normal position and the other one in its activated state. To the left there is a figure showing, on a greater scale, a vertical section through the fender.

Figure 2:
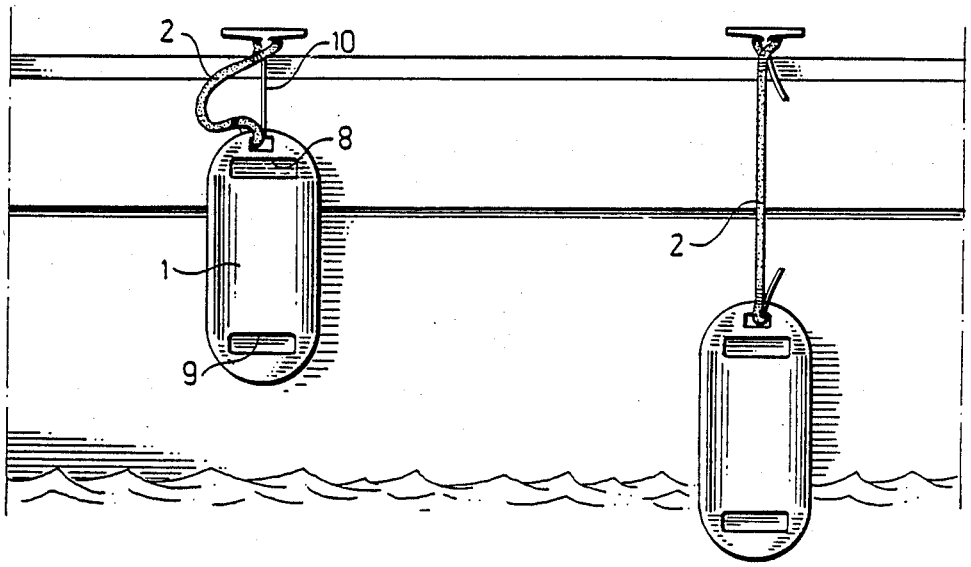

FIG. 2 illustrates the second embodiment of the invention.

In FIG. 1 there have been shown two fenders 1, each suspended in a line 2. The fender to the left is in its normal position, whereas the fender to the right is activated. The fender comprises an upper portion 3 and a lower portion 4 which normally are held together by a snapping action, e.g. in the way that the lower portion has an annular ridge cooperating with a groove in the upper portion as shown at 5 in the enlarged sectional view to the left. According to the embodiment of FIG. 1 the upper portion 3 has an inner cavity housing a rope ladder 6. The upper portion has an aperture 7 for the suspending line 2 and a greater aperture 8 which may serve as a footstep. Also the lower portion 4 has such a footstep aperture 9.

The mode of operation of the device shown in FIG. 1 is as follows. When a person in the water wants to use the device he inserts one hand into the aperture 9 and pulls downwards. This releases the snapping lock 5 whereby the lower portion 4 falls down, now connected with the upper portion by means of the rope ladder 6. The person in distress may then use the aperture 9, the rope ladder 6 and the aperture 8 to climb back aboard. It should be observed that it is not necessary for component 6 to be shaped like a conventional rope ladder. Thus, it may alternatively consist of a single line having loops or other suitable means which may serve as footsteps.

In the embodiment according to FIG. 2 the fender 1 is not divided into two portions as was the case in FIG. 1. It may actually to a great extent be of conventional design. However, it does in two important respects differ from conventional fenders. The one difference is that it has handgrip openings 8 and 9. The second difference is that it has two suspending lines, namely in addition to line 2 also a considerably thinner line 10 of such a length that, during normal conditions, the fender will be suspended at a suitable distance above the water surface. Line 10 may be given a maximum tensile strength of about 60 lbs. Consequently, if a person in the water inserts his one hand into opening 9 and pulls downwards with a force at least corresponding to the just-mentioned value, line 10 will burst and the fender will thereafter instead be suspended in the longer and stronger rope 2 as has been shown to the right in FIG. 2. The person may then use openings 9 and 8 as footsteps in the way described above in relation to FIG. 1.

It should be noted that the two embodiments of the invention here illustrated are intended to exemplify the inventive idea only meaning that the detailed design of the fender may be varied in several respects. The rather simple design of FIG. 2 is suitable together with boats having a low freeboard whereas the embodiment of FIG. 1 is preferred together with bigger boats. As has already been mentioned, the appearance of rope ladder 6 may be modified. The same applies to the locking device 5. Alternatively, the latter may operate in such a way that the lower portion is released from the upper portion by a turning movement rather than by pulling. It may also be suitable to give the lower portion 4 a smaller diameter than that of the upper portion 3 in order to minimize the risk of unintentional release when the device is exposed to lateral forces, i.e. when it acts as a fender.

Finally, it should be mentioned that a fender according to the invention may be used as a life-saving equipment in two further respects as well. One such possibility is the following one. One may pull a fender as shown in FIG. 1 apart, grip its one half and swing the other half around, the two portions being interconnected by the rope ladder.

When the device then is released it will, thanks to the contribution from the centrifugal force, possess a dynamic energy which makes it possible to throw it also to a distressed person at a rather long distance from the boat. The person in the water may then use the fender as a life-buoy. The second way of use is to have a long thin line connected to the device so that the person in the water can be pulled to the side of the boat. In any case, thanks to its lower weight, a device according to the invention can be thrown a considerably longer distance than a conventional life-buoy. An alternative way of expressing that advantage would be to say that it will be easier for children and for other persons with modest physical strength to assist a distressed person in the water.

We claim:

1. A combined marine fender and emergency ladder device, comprising:

(a) an elongate body member (1) having a vertical cross-section greater than a horizontal cross-section, (b) means (7) at an upper end of the body member for securing one end of a line (2) such that the body member may be suspended from a rail of a boat and hang down over the side of the boat hull to cushion impacts against other boats, pilings, and the like, and (c) a pair of horizontally elongate apertures (8,9) individually defined in opposite, upper and lower ends of the body member sufficiently large to serve as footsteps and/or handgrips to assist a person in the water, wherein:

(d) the body member comprises readily separable upper and lower portions (3,4), (e) one of said portions defines an internal cavity, and further comprising:

(f) a collapsible ladder (6) stored in said cavity and having opposite ends individually connected to said upper and lower portions such that upon the separation of said portion, as by a person in the water grasping and pulling on a lower one (9) of said apertures, the ladder becomes fully extended.

2. A device according to claim 1, wherein the ladder is a rope ladder.

3. A device according to claim 1, wherein the upper and lower body member portions are releasably coupled together by snap-lock means (5).

4. A combined marine fender and emergency ladder device, comprising:

(a) an elongate body member (1) having a vertical cross-section greater than a horizontal cross-section, (b) means (7) at an upper end of the body member for securing one end of a line (2) such that the body member may be suspended from a rail of a boat and hang down over the side of the boat hull to cushion impacts against other boats, pilings, and the like, and (c) a pair of horizontally elongate apertures (8,9) individually defined in opposite, upper and lower ends of the body member sufficiently large to serve as footsteps and/or handgrips to assist a person in the water.

(d) wherein said line has a high breaking strength, and further comprising, (e) a shorter, low breaking strength line (10) coupled to said securing means for suspending the body member from the boat rail, said low breaking strength line being rupturable by a person in the water grasping and pulling on a lower one (9) of said apertures such that the body member is thereafter suspended by the longer, high breaking strength line.

* * * * *